US005147247A

United States Patent [19]

Addleman

[11] Patent Number: 5,147,247

[45] Date of Patent: Sep. 15, 1992

[54] SWING THROW-OVER BARRIER

[75] Inventor: Keith A. Addleman, Hillsdale, Mich.

[73] Assignee: Quality Industries, Inc., Hillsdale, Mich.

[21] Appl. No.: 667,536

[22] Filed: Mar. 11, 1991

[51] Int. Cl.[5] ..... A63G 9/02
[52] U.S. Cl. ..... 472/118; 248/370
[58] Field of Search ..... 272/85-92; 248/370

[56] References Cited

U.S. PATENT DOCUMENTS 2,731,073 1/1956 Tonne .

FOREIGN PATENT DOCUMENTS 1252918 12/1960 France ..... 248/370
1563723 5/1990 U.S.S.R. ..... 272/85
2053702 2/1981 United Kingdom .

*Primary Examiner*—Richard E. Chilcot, Jr.
*Attorney, Agent, or Firm*—Beaman & Beaman

[57] ABSTRACT

A barrier assembly for swings or similar recreational or exercise equipment is mounted by means of a split-clamp bracket on the top crossbeam extending vertically outward from the beam to prevent the throwing over of swings which would result in a winding up of a flexible suspension strand such as a chain around the crossbeam.

7 Claims, 1 Drawing Sheet

SWING THROW-OVER BARRIER

BACKGROUND OF THE INVENTION

1. Field of the Invention

The present application relates to playground, amusement or exercise apparatus employing a seat pivotally suspended from a crossbeam by a flexible suspension strand such a chain generally referred to as a swing. More specifically, the invention relates to devices designed to prevent or discourage the throwing over the crossbeam of swing seats thereby causing the winding up of the chain on the crossbeam.

2. Description of Related Art

Swings designed for recreation and exercise are well known in the art. The vast majority of configurations employ suspension strands of chain, links or rope by which the seat is pivotally suspended from a crossbeam. The chain and rope swing configurations are inherently susceptible to vandals throwing the swing over the crossbeam and winding the strand about the crossbeam rendering the swing unusable.

The aforementioned problem is well known in the art and has been addressed by British Patent No. 2,053,702 which employs axially mounted horizontal buffer or braking rails removed from, but adjacent to the crossbeam in combination with rigid or semi-rigid elongated members which are connected to the crossbeam by pivot means. The preferred embodiment of this invention calls for the rigid member length to be 25% to 50% of the total swing suspension length to prevent throwover. This hybrid suspension configuration is much less flexible than the commonly used chain or rope swings and is more expensive to produce.

OBJECTS OF THE INVENTION

The principal object of the invention is to provide a light weight, inexpensive and effective means to prevent swing seats from being thrown over a swing crossbeam.

Another object of the invention is to provide a swing throw-over barrier system adaptable to crossbeams of varying lengths which can be readily shipped via common carrier in a standard size package.

A further object of the invention is to provide a swing throwover barrier assembly which is easy to assemble and install and does not require special skills.

SUMMARY OF THE INVENTION

The swing throw-over barrier, in accord with the invention, is comprised of at least one section consisting of a vertically mounted, essentially rectangular frame comprised of a "U" shaped member. The "U" shaped member open ends are closed by a crossmember spaced from the open ends of the "U" member. This setback from the frame open ends permits each of the open ends to be inserted into a mounting bracket and thereby securely mounted on the swing set crossbeam.

The mounting bracket is of a split clamp construction having two similarly shaped complementary halves. The two halves assemble facing each other thereby forming two transversely related cylindrical channels. The larger channel is sized to receive the swing crossbeam, and the smaller, perpendicular channel is sized to receive the frame open ends.

In order to permit the barrier to be used with crossbeams of various lengths the barrier is formed in sections each of a length less than that of the crossbeam.

Thus, by using a plurality of barriers a "custom" installation for each swing crossbeam can be achieved, and similar small central barrier sections are used to fill in the spacing between larger "end" barrier sections. Accordingly, by making standard end and central barrier sections available the invention may be installed on any crossbeam length. Also, by limiting the size of the barriers standard common carrier size packaging can be used for shipping.

BRIEF DESCRIPTION OF THE DRAWINGS

In order that the invention may be clearly understood, it will now be described, by way of example, with reference to the accompanying drawings, wherein.

DESCRIPTION OF THE PREFERRED EMBODIMENTS

Figure 1:
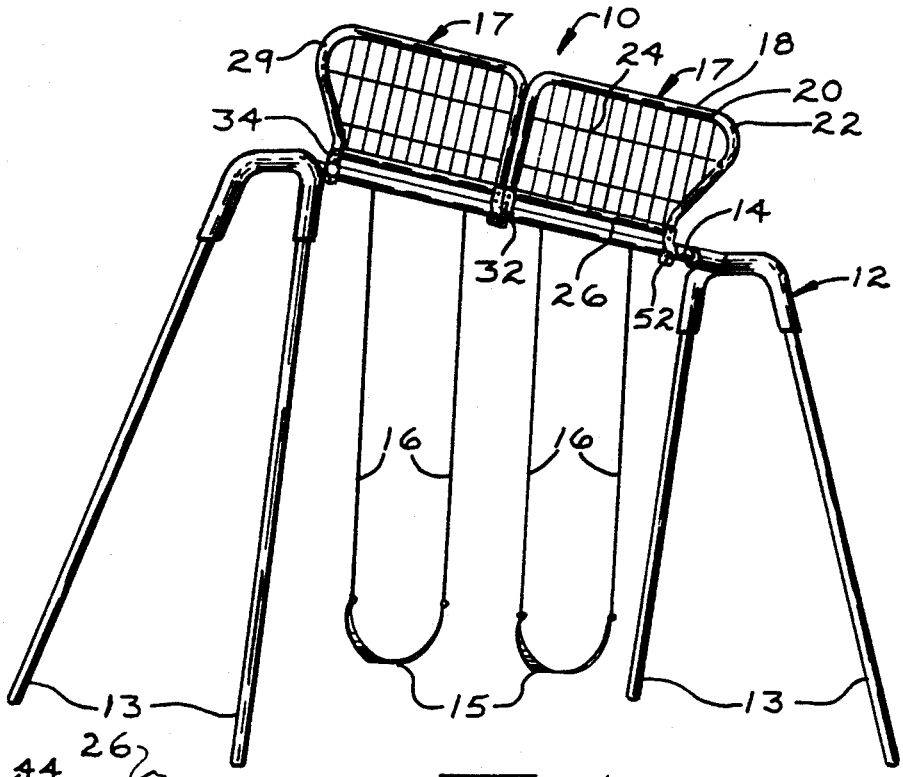
FIG. 1 is a perspective view of a swing with a two panel barrier installed in accord with the invention.
Figure 3:
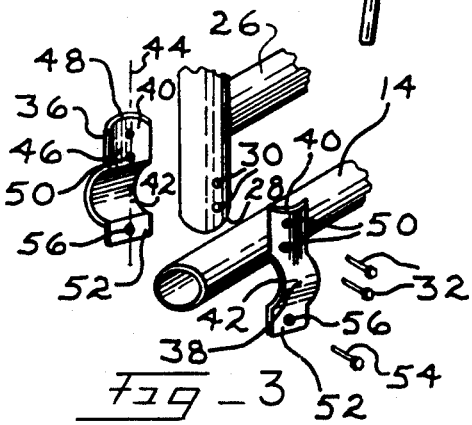
FIG. 3 is an exploded view of a barrier mounting bracket in accord with the invention.
Figure 2:
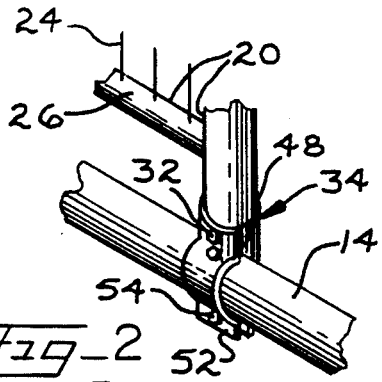
FIG. 2 is a detail perspective view of a barrier mounting bracket in accord with the invention.

Referring now to the drawings in detail, there is illustrated a preferred form of the swing throw-over barrier generally indicated as numeral 10. The barrier can be comprised of several sections or panels of varying widths to accommodate various crossbeam lengths.

Figure 4:
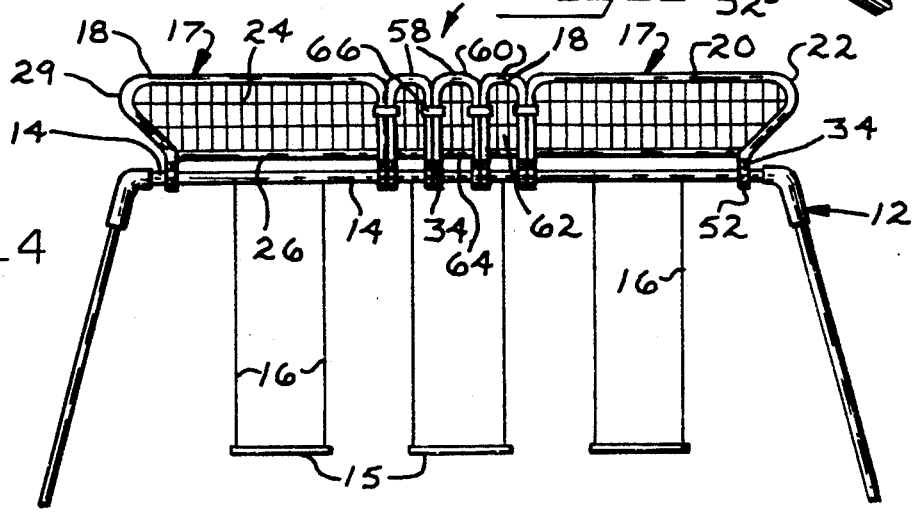
FIG. 4 is a front elevation view of a swing with multiple panel sizes installed in accord with the invention.

The invention is intended to be mounted to the horizontal crossbeam 14 supported on legs 13 of a swing set 12 to prevent throwing swing seats 15 over the crossbeam and consequently wrapping the flexible swing seat suspension strand 16, usually a chain, around the crossbeam 14. The barrier 10 is comprised of at least two identical sections 17 as shown in FIG. 1, each of which has a generally planar frame 18 defining an inner boundary 20 and an outer boundary 22 with a wire mesh filler 24 which may be fastened to the frame 18 through any number of means including spot welding. The use of a mesh filler minimizes the barrier weight for shipping while preventing the seat and chain from passing through the frame. The frame 18, which may be fabricated of materials such as tubular steel, aluminum or high impact plastic, has an essentially inverted "U" shape with a welded crossmember 26 joining the open ends 28 thereby closing the frame as shown in FIGS. 1 and 4, essentially forming a rectangular figure having upper convex outer wings 29.

The frame open ends 28 have two mounting bracket holes 30 defined on its surface for frame bolts 32 or equivalent fastening means to pass through. The frame ends 28 insert into mounting brackets 34 for connection to the crossbeam 14. The mounting brackets 34 are of a split clamp construction having identically shaped first parts 36 and second parts 38. Each of the mounting bracket parts has an inner surface 40 with two transversely related concave recesses defined thereon. The swing set crossbeam 14 is received within the larger of the two recesses 42 perpendicular to the bracket axis 44. The smaller concave recess 46 is parallel to the bracket axis 44 and extends from the larger concave recess 42 to intersect the bracket first end 48. The bracket first end receives the barrier frame open ends 28 and has opposing mounting bolt holes 50 defined on the concave surfaces which align with the frame end bolt holes 30 during assembly. The mounting bolts 32 which are inserted through the two bracket frame mounting bolt holes 50 and frame bolt holes 30 are secured by nuts thereby securing the frame ends therein. The bracket first part 36 and second part 38 extend along the bracket longitudinal axis 44 to the opposite side 52 of the crossbeam recess 42 and are joined by a clamping bolt 54. The bolt 54 passes through aligned bracket clamping bolt holes 56 defined in the bracket first part and the bracket second part and then is secured by a nut thereby clamping the crossbeam in its channel as defined by recesses 42. The bracket 34, frame 18 and crossbeam 14 are thereby rigidly connected.

From the above description it will be appreciated that the swing throw-over barrier sections 17 may be readily mounted upon the crossbeam 14 of a swing set 12. The barrier sections may be retrofitted to existing swings, or may be mounted upon new swing sets at the time of original installation.

As the barrier sections 17 usually extend upwardly two feet or more from the crossbeam 14 the barriers discourage vandals from throwing the seats 15 over the crossbeam and wrapping the swing strands 16 thereabout. It is appreciated that it is possible to throw the seats and associated suspension strands over the top of the barrier, but due to the added height of the swing set provided by the barrier such action becomes difficult.

With swing sets 12 having a crossbeam 14 for accommodating only a pair of swings as shown in FIG. 1, two sections 17 usually suffice to provide adequate protection against throw-over. However, as many swing sets utilize crossbeams of sufficient length to accommodate three or more swings, and as it is desired to form the barrier sections 17 of standard length, with a longer swing set such as shown in FIG. 4, additional barrier sections are required intermediate the sections 17 located adjacent the crossbeam ends. Accordingly, the invention contemplates the use of identical smaller barrier sections or panels 58 interposed between the sections 17.

The sections 58, three of which are shown in FIG. 4, are identical and are each of an inverted U-shaped configuration as defined by frame 60, and the mesh 62 is mounted upon the frame 60 so as to fill in the space between the frame. The lower end of the frame 60 is attached to the crossbeam 14 in a manner identical to that previously described utilizing clamps 34, and a crossmember 64 encloses the lower region of the sections 58. If desired, split clamps 66 may be used to interconnect the adjacent vertical portions of the sections 58, and sections 17 and 58, or holes may be drilled through the sections and the sections interconnected by bolts.

The use of the smaller modular barrier sections 58 permits the inventive concepts to be economically utilized eliminating the necessity for specially constructed throw-over barrier sizes for particular swing set crossbeam sizes. One, two, three or more sections 58 may be interposed between the end barrier sections 17 as required to accommodate the particular crossbeam length upon which the barriers are mounted.

A further advantage of dimensioning the horizontal length of the sections 17 and 58 to a relatively concise dimension, such as four feet or less, lies in the fact that the shipping packaging for the barrier sections is relatively concise and does not create expensive shipping problems.

It is appreciated that various modifications to the inventive concepts may be apparent to those skilled in the art without departing from the spirit and scope of the invention.

I claim:

1. A barrier for use in conjunction with a playground swing set having a substantially horizontal top crossbeam having ends and including a swing suspended on flexible strands from the crossbeam for preventing the swing from being thrown over the crossbeam comprising, in combination, a frame having a generally planar configuration, swing barrier means mounted on said frame, and fastening means substantially vertically mounting said frame upon the swing set adjacent and above the crossbeam whereby said frame plane is substantially vertically oriented above the crossbeam, said frame having a vertical height sufficient to render the throwing of a swing thereover difficult.

2. In a barrier for use with a playground swing as in claim 1, said swing barrier means being disposed across said frame.

3. In a barrier for use with a playground swing as in claim 2, said swing barrier means comprising a mesh.

4. In a barrier for use with a playground swing as in claim 1, said fastening means mounting said frame upon the crossbeam.

5. In a barrier for use with a playground swing as in claim 1, a plurality of frames having swing barrier means defined thereon mounted upon the swing set defining a total barrier length substantially equal to the crossbeam length.

6. In a barrier for use with a playground swing as in claim 5, a pair of end section frames mounted on the swing set crossbeam, a section being located adjacent each crossbeam end, and at least one central modular frame having swing barrier means defined thereon located between the end section frames and fastening means attaching said modular frame to the crossbeam.

7. In a barrier for use with a playground swing as in claim 6, said modular frame being of a horizontal length less than the horizontal length of an end section frame.

* * * * *